US006262378B1

(12) United States Patent
Chou

(10) Patent No.: US 6,262,378 B1
(45) Date of Patent: Jul. 17, 2001

(54) ROTARY SWITCH

(75) Inventor: Chin-Wen Chou, Taipei (TW)

(73) Assignee: Shin Jiuh Corp., Taipei Hsien (TW)

( * ) Notice: Subject to any disclaimer, the term of this patent is extended or adjusted under 35 U.S.C. 154(b) by 0 days.

(21) Appl. No.: 09/624,611

(22) Filed: Jul. 24, 2000

Related U.S. Application Data

(63) Continuation-in-part of application No. 09/563,344, filed on May 3, 2000.

(51) Int. Cl.[7] ..... H01H 9/00; H01H 25/06

(52) U.S. Cl. ..... 200/4; 200/18; 200/565; 200/569; 200/6 B; 200/6 BB

(58) Field of Search ..... 200/1 A, 4, 5 R, 200/5 A, 6 R, 6 B, 6 BA, 6 BB, 6 C, 11 R–11 TW, 558, 559, 562–569, 573, 303, 17 R, 18

(56) References Cited

U.S. PATENT DOCUMENTS 4,133,990 * 1/1979 Wanner et al. ..... 200/6 B
4,539,444 * 9/1985 Senoh ..... 200/5 R
4,758,693 * 7/1988 Hoffman ..... 200/11 R
5,008,498 * 4/1991 Yamazaki ..... 200/11 R
5,010,214 * 4/1991 Yamazaki ..... 200/6 B
5,315,077 * 5/1994 Simon et al. ..... 200/11 R
5,436,413 * 7/1995 Katakami ..... 200/14
5,847,335 * 12/1998 Sugahara et al. ..... 200/4
5,952,628 * 9/1999 Sato et al. ..... 200/4

* cited by examiner

*Primary Examiner*—J. R. Scott
(74) *Attorney, Agent, or Firm*—Bacon & Thomas, PLLC

(57) ABSTRACT

A rotary switch has a rotary dial, an operation shaft, a housing, a rotary plate and a circuit board. A binding member extends from the rotary dial and inserts through a central through hole of the housing and connects to the contact plate to allow the rotary dial and the contact plate to rotate together. The housing and the circuit board attach and remain stationary, independent of any rotational movement of the rotary dial. The contact plate has a plurality of contact protrusions that extend in a predetermined pattern so that in accordance with rotation of the rotary dial, at least one contact protrusion is brought into electrical contact with at least one linear contact member belonging to a contact member array positioned on the circuit board. The rotary switch operates when a shaft contact portion mounted on the circuit board is pressed by a lower end of the operation shaft in accordance with axial movement of the operation shaft

7 Claims, 10 Drawing Sheets

PRIOR ART Fig. 1

| POSITION | C2 | C3 | C4 | C5 | 16 | C1 |
|---|---|---|---|---|---|---|
| 0 | 0 | 0 | 0 | 0 | | |
| 1 | 0 | 0 | 0 | 1 | | |
| 2 | 0 | 0 | 1 | 1 | | |
| 3 | 0 | 0 | 1 | 0 | | |
| 4 | 0 | 1 | 1 | 0 | | |
| 5 | 0 | 1 | 1 | 1 | | |
| 6 | 0 | 1 | 0 | 1 | | |
| 7 | 0 | 1 | 0 | 0 | | |
| 8 | 1 | 1 | 0 | 0 | | |
| 9 | 1 | 1 | 0 | 1 | | |
| 10 | 1 | 1 | 1 | 1 | | |
| 11 | 1 | 1 | 1 | 0 | | |
| 12 | 1 | 0 | 1 | 0 | | |
| 13 | 1 | 0 | 1 | 1 | | |
| 14 | 1 | 0 | 0 | 1 | | |
| 15 | 1 | 0 | 0 | 0 | | |

Fig. 8B

ROTARY SWITCH

CROSS-REFERENCE TO RELATED APPLICATION

The present invention is a continuation-in-part of patent application Ser. No. 09/563,344, filed May 3, 2000.

BACKGROUND OF THE INVENTION

This invention relates generally to a rotary switch, more particularly, to a rotary switch that can create multiple sets of circuit signals by using a rotary dial that has a plurality of multiple sets of contacts that engage with other associated contacts on a circuit board.

FIG. 1 illustrates a previous application dated May 3, 2000 and numbered Ser. No. 09/563,344 seeking for patent, regarding an improved rotary switch proposed by the present inventor.

The previous rotary switch comprises a rotary dial 106, a housing 103 as a platform that supports the rotary dial 106, a contact plate 102 disposed in the housing 103 and arranged so as to rotate with said rotary dial 106, and a circuit board 101 rigidly attached to said housing 103. A shaft contact portion 132 and a contact member array 112 are arranged on the circuit board 101. The contact plate 102 has a plurality of contact protrusions 122 on a surface of said contact plate 102 facing the circuit board 101 and arranged in a predetermined pattern so as to communicate in a variety of settings with said contact member array 112. A user applies a force on the rotary dial 106 to rotate the contact plate 102 to enable some of the contact protrusions 22 to press and contact some of the contact members of the contact member array 112 to create different circuit signals. The user then depresses an operating shaft 105 to enable the shaft contact portion 111 to effect a circuit for output the mentioned circuit signals so that multiple circuit signals and two-stage control are made possible.

Some problems arise with the mentioned rotary switch:

1. Clearance between the rotary dial 106 and the housing 103 is excessive, and the rotary dial 106 is liable to skew under operation.
2. It is difficult to correctly assemble the rotary switch so that there is conformity between software and the alignment of the shaft contact portion to prevent erroneous commands.
3. As a result of the configuration of the assembled switch, circuit layout on the circuit board is difficult and hence, a secondary processing job is required.
4. The protruding section of the shaft contact portion wears out easily due to the rigidity of the operation shaft 105. Moreover, as the operation shaft 105 lacks positioning design, it may be inadvertently moved by the rotary dial.
5. Molding is difficult for the complicated structure of a resilient indexing ring 104 and a plurality of slide-guiding grooves disposed between the rotary dial and the housing. Further, when the rotary dial is skewed, the indexing ring 104 will be inevitably deformed and hinder operation of the rotary switch.

SUMMARY OF THE INVENTION

The primary object of this invention is to provide a rotary switch that can enhance a user's manipulative feeling during operation, create multiple circuitry signals, and provide for easy assembly so as to eliminate the above-said defects or inconveniences.

The improvements include the following:

1. A plurality of circular support projections extending from a side of a rotary dial that communicate with the housing so as to prevent skew of the control panel when rotating.
2. An indexing band frame arranged on the rotary dial for holding an indexing band that communicates with a plurality of axially extending cams separated by grooves and spaced circumferentially around a central through hole on the housing. The indexing band has a central ridge that engages with the cams so as to index the rotation of the rotary dial and provide an audible click when the rotary dial is rotated.
3. A resilient bushing made of a material with lesser rigidity, such as rubber or plastics, is received by the operation shaft, and contacts the shaft contact portion. The resilient bushing prevents less wear on the shaft contact portion. A mutual terminal and a plurality of connecting terminals are adopted for transmission of more distinct output signals.
4. A binding member extending from the rotary dial has a side lug that is received by a contact plate. The operation shaft has two diametrically opposed wing protrusions extending radially from the lower end. The wing protrusions are received by two grooves formed by the circuit board to provide for alignment during assembly and to avoid erroneous instructions.
5. The operation shaft comprises a notch located at a top end for receiving an press button. The rotary dial is arranged to receive a turntable to cover the side opposite to the side facing the housing. The circuit board has a plurality of fixing feet adapted for installation on an electronic device.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which:

FIG. 8B is a truth table of a rotary switch; and

DETAILED DESCRIPTION OF THE PREFERRED EMBODIMENT

Figure 1:
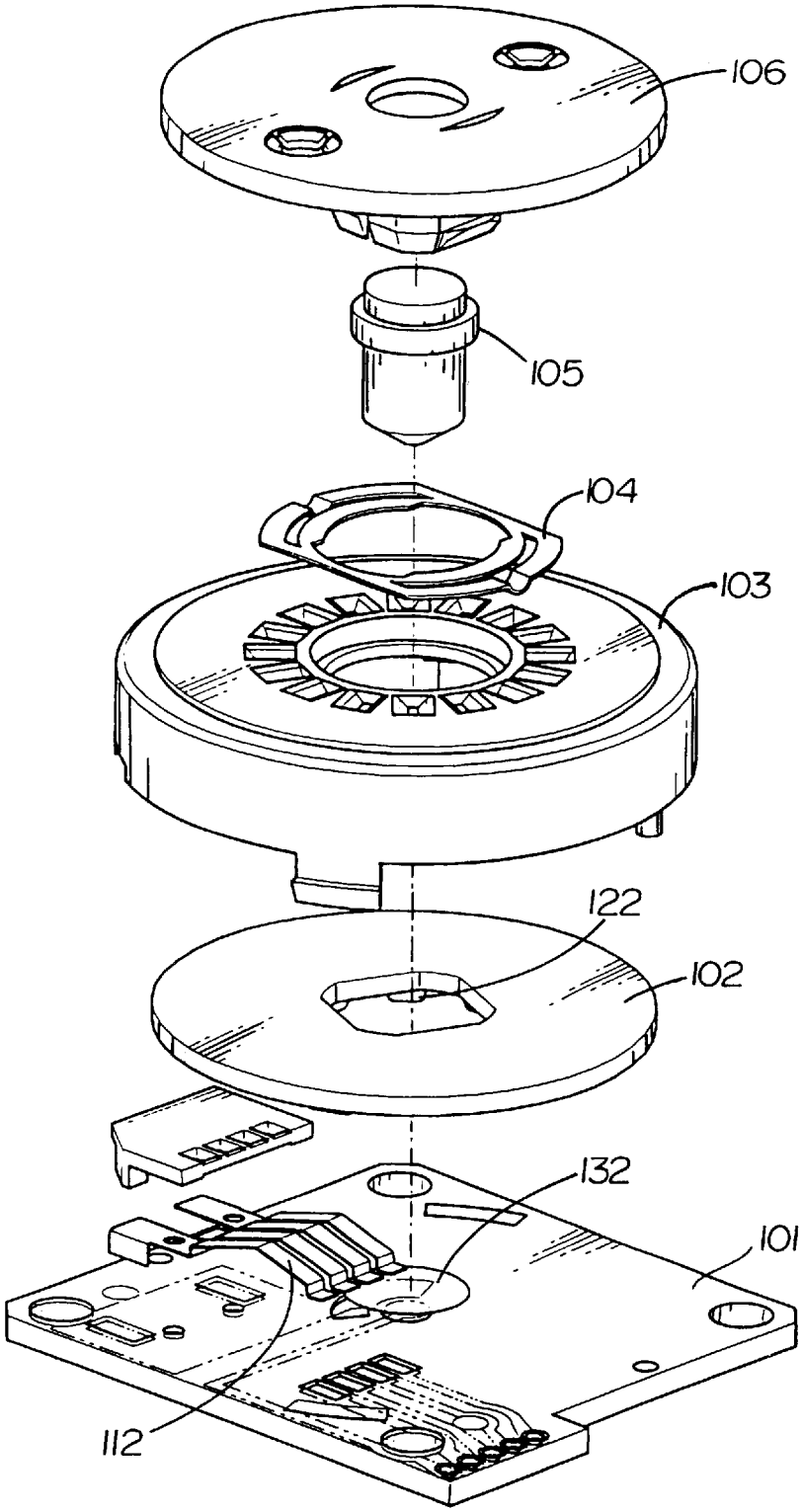
FIG. 1 is an exploded elevation perspective view of the prior art.
Figure 2:
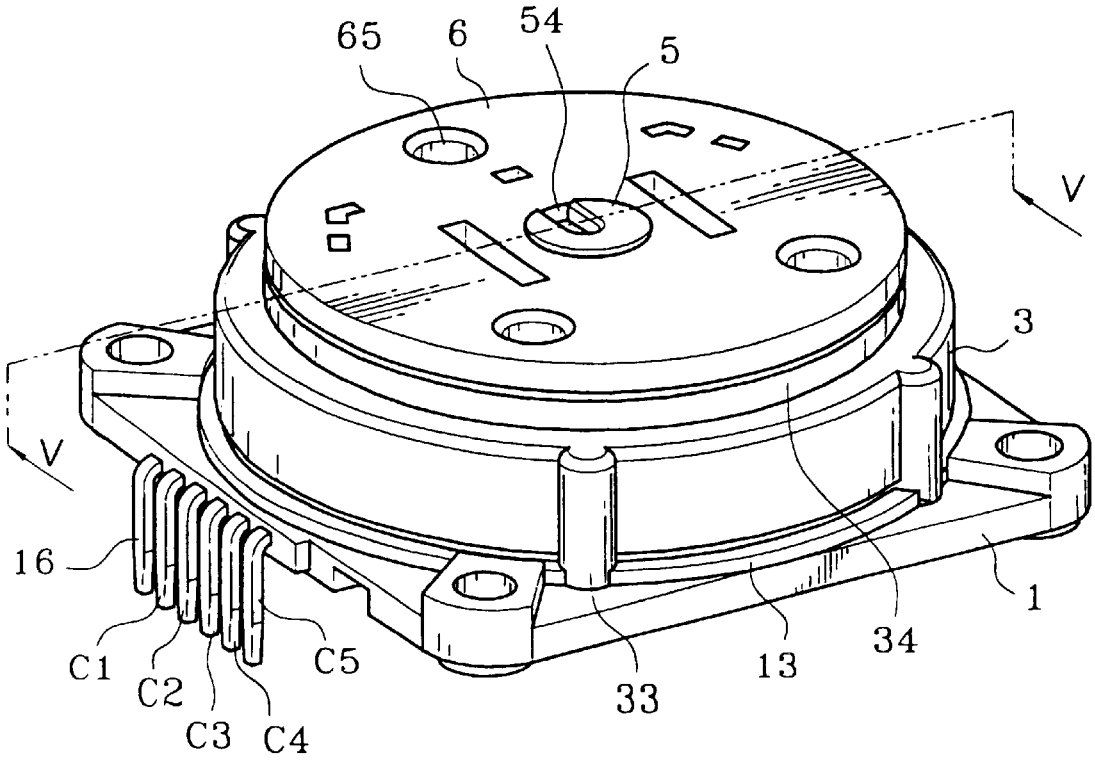
FIG. 2 is a perspective view of a rotary switch.
Figure 3:
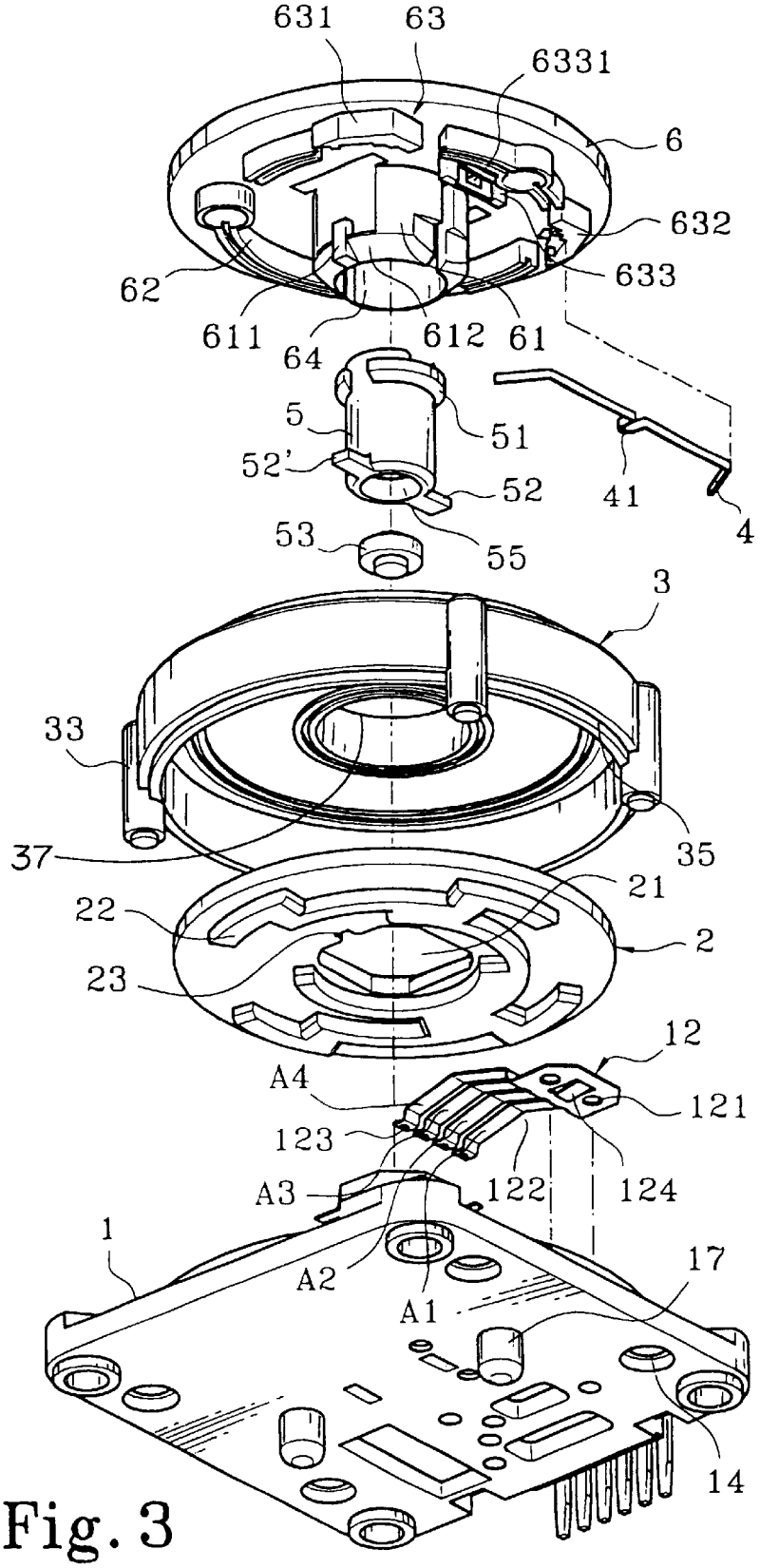
FIG. 3 is an exploded elevation perspective view of a rotary switch.
Figure 4:
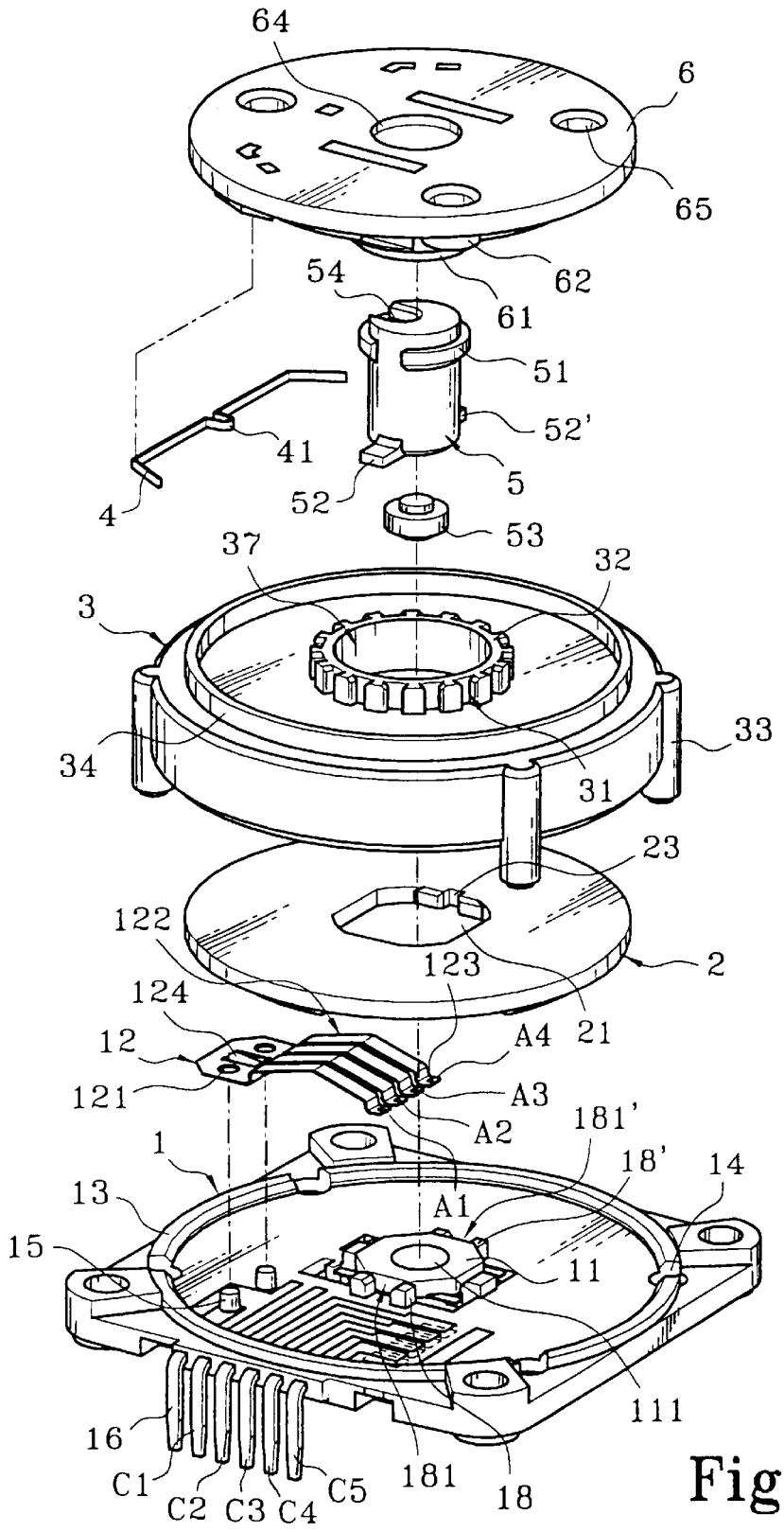
FIG. 4 is another exploded elevation perspective of a rotary switch.

As illustrated in FIGS. 2, 3, 4, and 5A, a rotary switch of this invention serving for a plurality of function keys or a provider of a group of adjustment signals comprises a rotary dial 6, a housing 3 serving as a platform supporting the rotary dial 6, a contact plate 2 located in the housing 3 and attached to the rotary dial 6, and a circuit board 1 connected to the housing 3.

The rotary dial 6 comprises a central first through hole 64 and a cylindrical, binding member 61 that extends from the peripheral edge of the first through hole 64 and is coaxial to the first through hole 64. The binding member 61 is partly cut into two semicircular flexible pieces with a side lug 611 located at the lower end of binding member 61 and extends towards the depth of the binding member 61, and is received by a notch 23 located at an inner peripheral portion of a square-shaped through hole 21 of the contact plate 2. The binding member is chamfered around an outer peripheral portion 612 at the lower end.

An operation shaft 5 extends through the binding member 61 and through the first through hole 64 at one end and extends through a second central through hole formed by the housing and the square shaped through hole 21 of the contact plate 2. The operation shaft 5 has a lower portion that has two diametrically opposed wing protrusions 52, 52' that extend radially from the lower end of the operation shaft 5 so as to be received by two grooves 181, 181' formed by the circuit board 1. The operation shaft 5 has a radially extending flange 51 located on an upper portion of the operation shaft 5 near a top end. The flange 51 has a diameter greater than the first through hole 64.

The rotary dial 6 includes a plurality of circular support projections 62 that are located near the periphery and concentrically extend axially from the rotary dial 6 so as to be received by a ring 34 formed by the housing 3. The rotary dial 6 also includes an indexing band frame 63 that is arranged to hold an indexing band 4 that has a central ridge 41. The stationary frame 63 is positioned tangential to a plurality of axially extending cams 31 separated by grooves and spaced circumferentially around the central through hole 37 of the housing 3. The indexing frame 63 comprises two mounting segments 631, 632 and a center mount 633 forming a central hole 6331 for receiving the central ridge 41 of the indexing band 4. The central ridge 4 engages with the cams 32 so as to index the rotation of the rotary dial 6.

A positioning pin 33 and a paired positioning hole 14 are provided to the housing 3 and the circuit board 1 respectively for attachment. A circular flange 13 and a matchable circular groove 35 are disposed on the circuit board 1 or in the housing 3 respectively so as to provide positioning aid for the assembly of the rotary switch.

Figure 9:
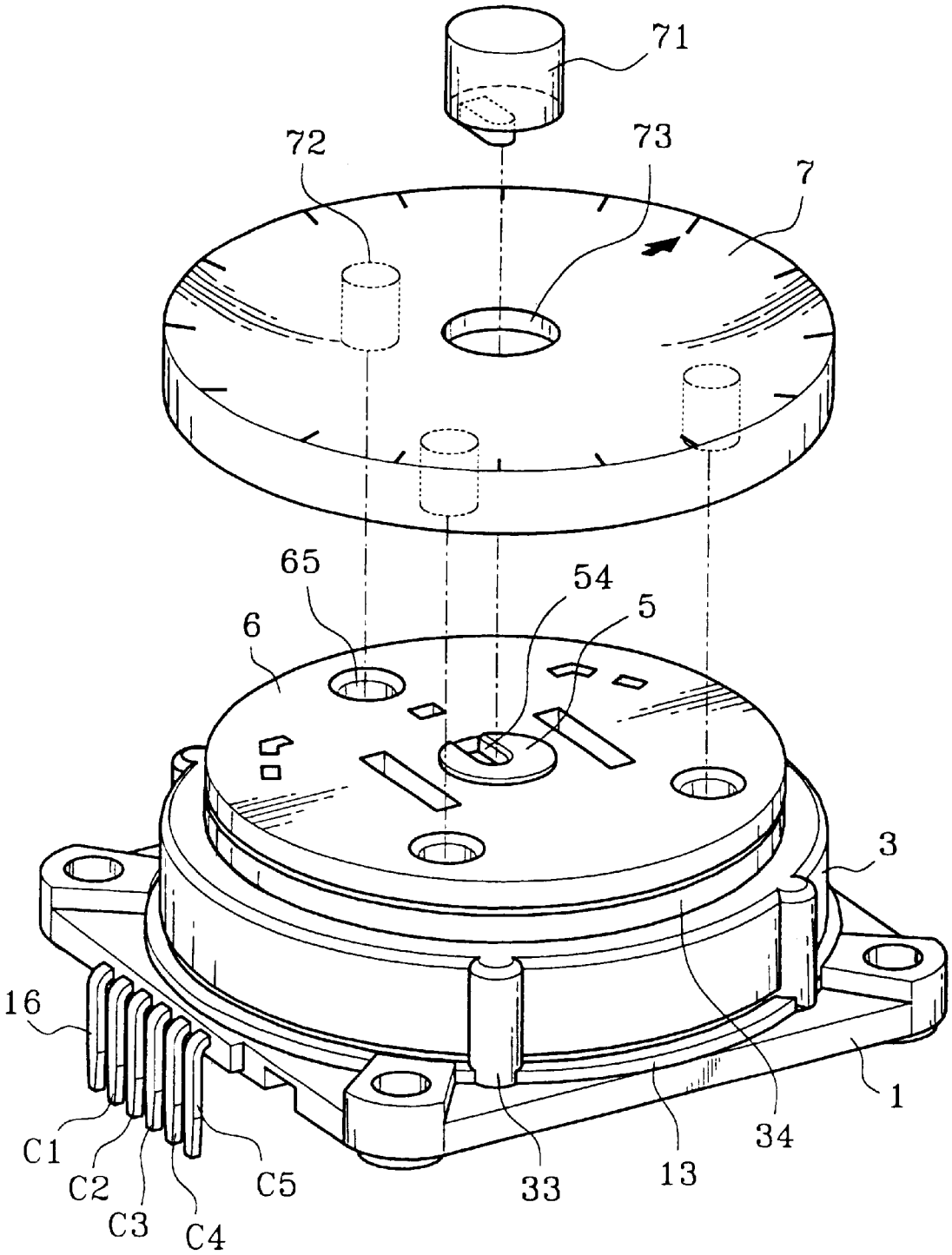
FIG. 9 is a perspective view of another embodiment of a rotary switch.

Alternatively, as shown in FIG. 9, the rotary dial 6 has a plurality of holes 65 spaced circumferentially for receiving a plurality of pins 72 of a turntable 7. The operation shaft 5 has a notch 54 located on the top end and extending to the depth of the operation shaft 5. The notch 54 receives an press button 71 to form a unitary rotary-switch module. Furthermore, the circuit board 1 has a plurality of fixing terminals 17 adapted to communicate with an electronic device requiring a rotary switch.

Figure 5A:
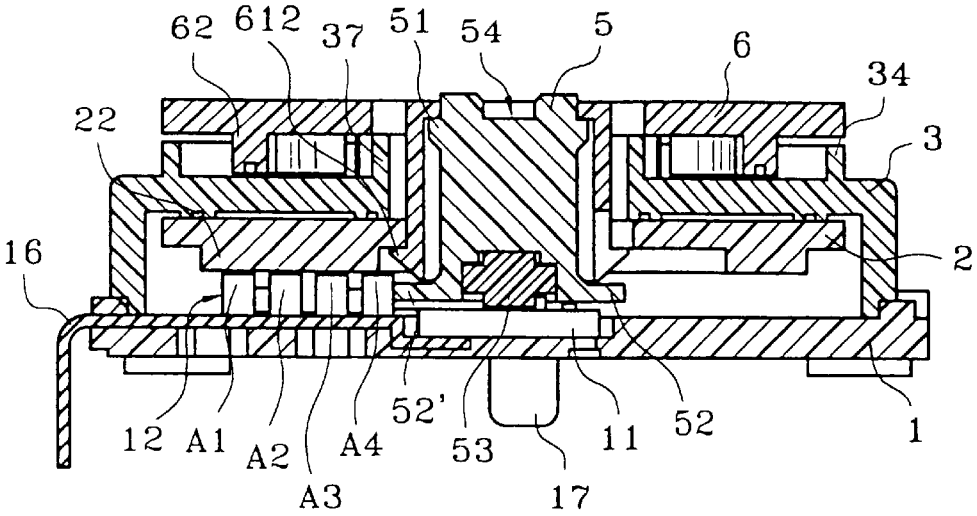
FIG. 5A is a sectional view taken along line V—V of FIG. 2.
Figure 5B:
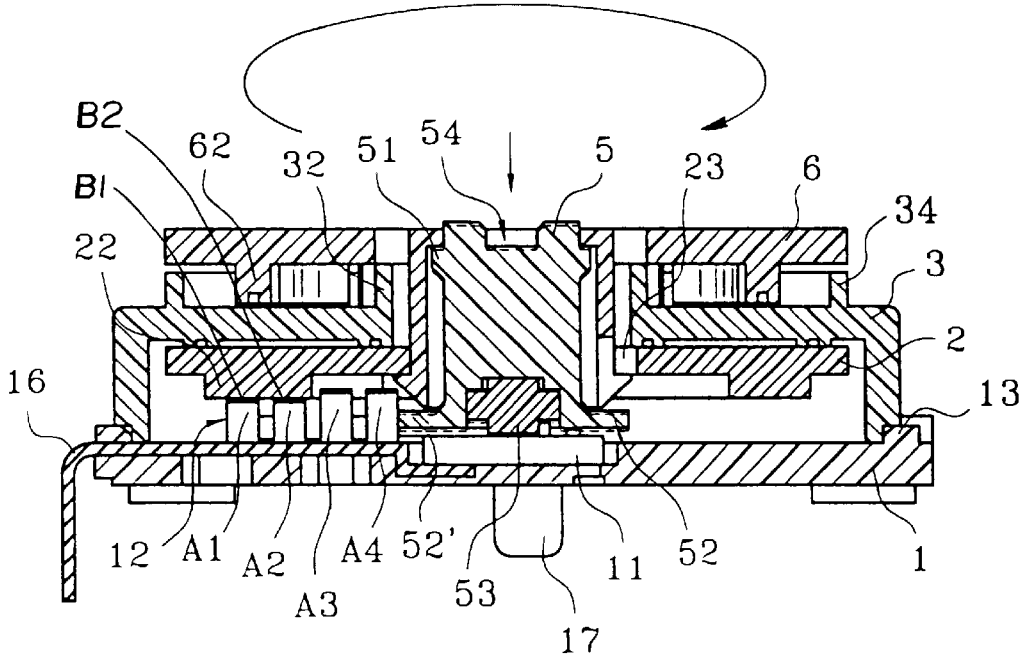
FIG. 5B is a sectional view taken along line V—V of FIG. 2 showing the direction of rotation of a rotary dial and the axial operational direction of an operation shaft.
Figure 6:
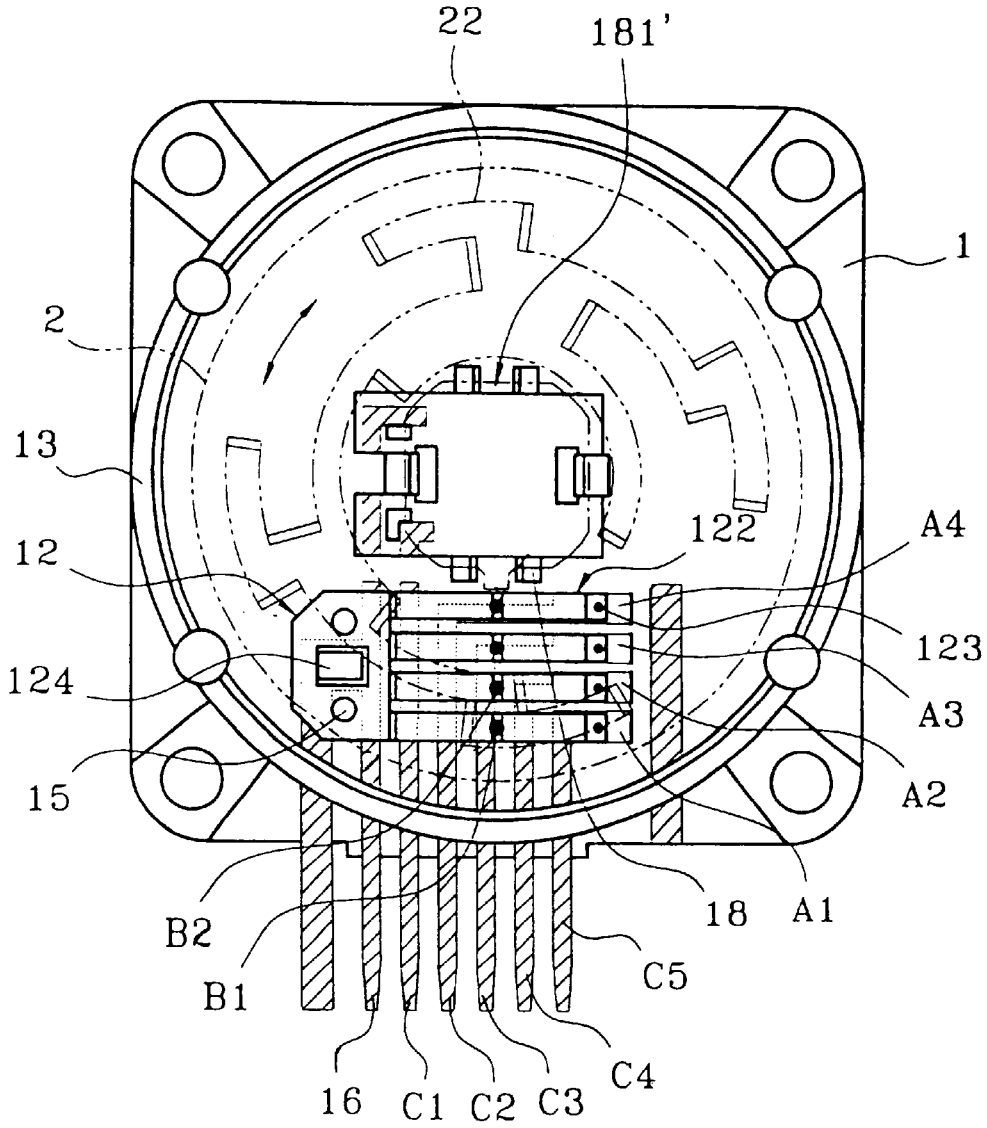
FIG. 6 is a plan view of a rotary switch.

Referring to FIGS. 5A, 5B and 6, the shaft contact potion 111 and the contact member array 12 are connected to the circuit board 1 for circuit connection via a mutual terminal 16 and a plurality of connecting terminals C1, C2, C3, C4, C5. The connecting terminals C1, C2, C3, C4, C5 are mounted on the circuit board 1 and have portions that project outward from the circuit board 1. The shaft contact portion 111 is a resilient switch or a tact switch provided with a circuit 11 for propping against the operation shaft 5. The contact member array 12 forms a plurality of holes 121 at one end that are received by a plurality of protruding rods 15 connected to the circuit board 1. The contact member array 12 comprises a plurality of resilient linear members (A1, A2, A3, A4) that have a central portion 122 that projects transversely from the plane of the circuit board 1 so as to form at least one contact point that communicates with portions of a contact protrusion pattern 22. The linear contact array 12 has another end 123 that communicates with contact leads 18 that correspond to connecting terminals C2, C3, C4, C5.

A predetermined contact protrusions pattern 22 is radially arranged on a lateral face of the contact plate 2 for creating a variety of circuitry signals according to predetermined combinations and alignments. The operation shaft 5 is movable up and down and disposed at a position corresponding to the shaft contact portion 111 for depressing the latter, wherein a recess 55 is formed in the bottom end of the operation shaft 5 for accommodating a resilient bushing 53 made of a material with lesser rigidity, such as rubber, plastics, etc.

Figure 7A:
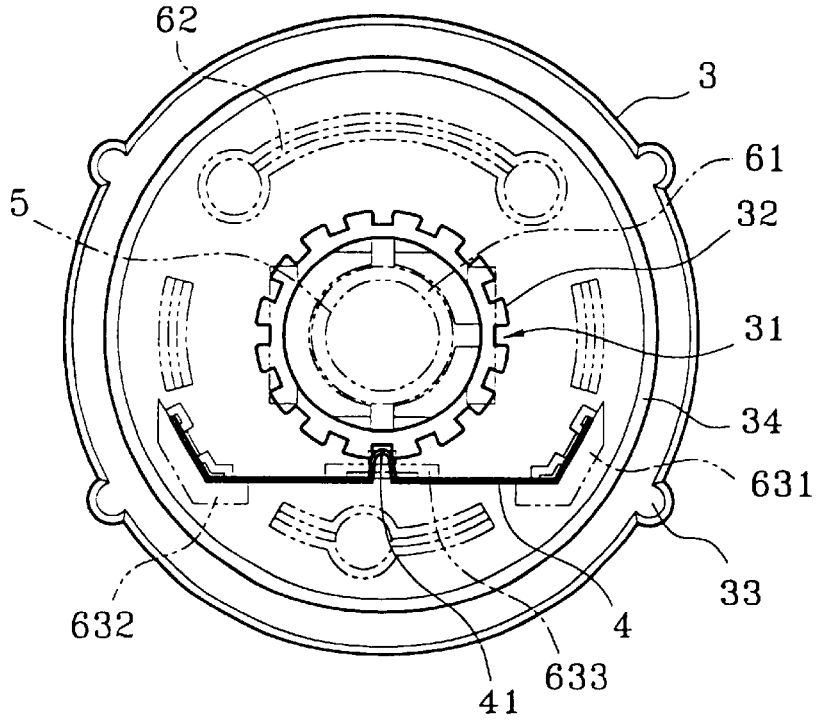
FIGS. 7A and 7B are plan views on which an indexing ring is positioned with a plurality of cams.
Figure 7B:
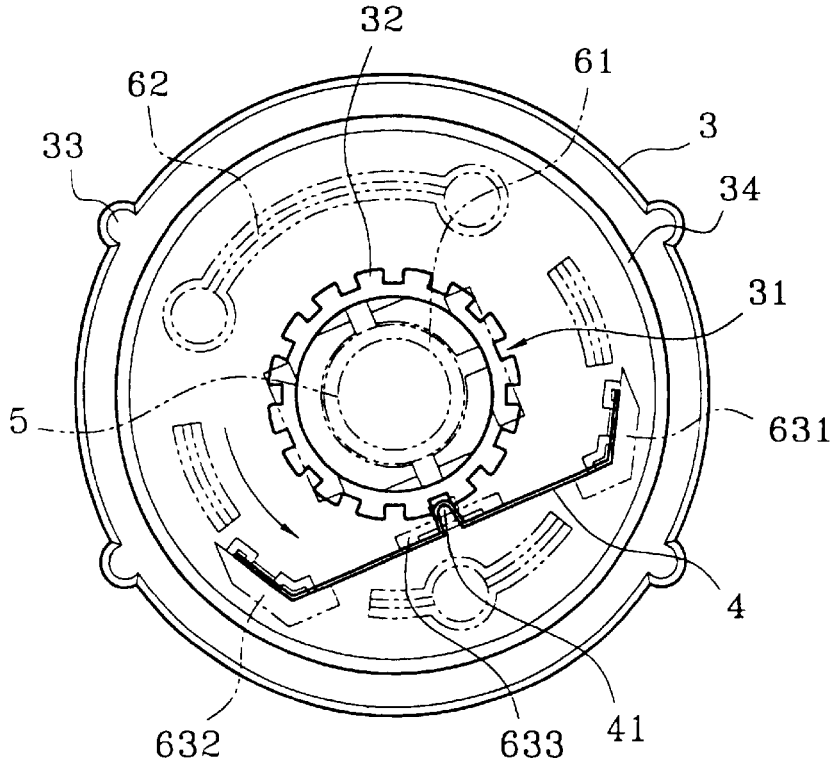

When the rotary dial 6 or the indexed turntable 7 are rotated (e.g., web linking for web-site searching, etc.) as shown in FIGS. 7A and 7B, the central ridge 41 of the indexing band 4 communicates with the cams 31 to index the rotation of the rotary dial 6 and provide an audible click. The indexing arrangement of the rotary dial provides a better manipulative feeling and helps avoid erroneous commands.

Figure 8A:
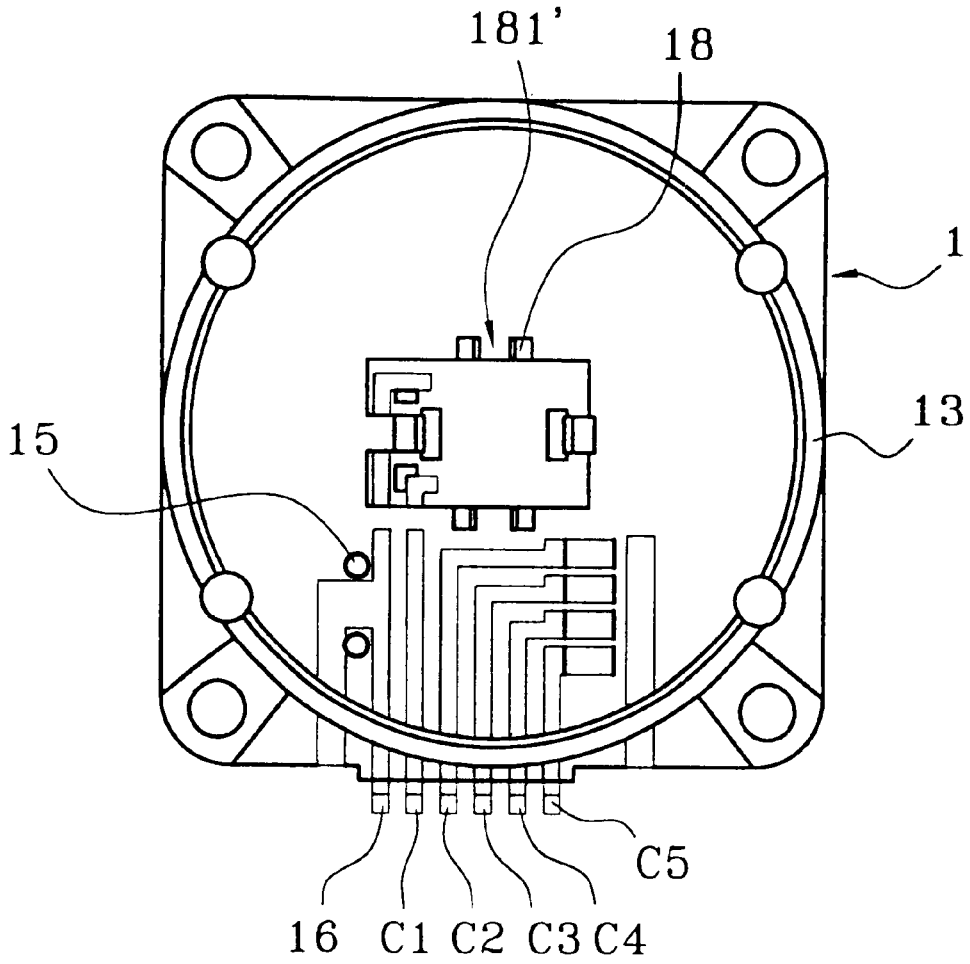
FIG. 8A is a plan view of a binary encoding of this invention.

In more detailed operation, when a different portion of the contact protrusion pattern 22 of the contact plate 2 rotates to contact the contact member array 12, the portion of the contact protrusion pattern 22 will depress the resilient contact members (A1, A2, A3, A4) of the contact member array 12. For example, as illustrated in FIGS. 5B and 6, when portions B1 and B2 of the contact protrusion pattern 22 depress resilient contact members A1 and A2, the depressing points 123 at the other end of the contact members 122 will depress downward to contact the connecting terminals C4 and C5 under the contact member array 12. At this moment, resilient contact members A3 and A4 are not depressed because they are not in contact with the portion of the contact protrusion pattern 22. On the other hand, the other end of the contact member array 12 contacts the mutual terminal 16 via a connecting piece 124 to create a predetermined signal. As shown in FIGS. 8A and 8B, the rotary dial 6 rotates to reach POSITION 2 to create a predetermined signal (0011) for, as an example, web linking to a medical-care web site. At this moment, the signal is not yet transmitted until the press button 71 is depressed to drive the operation shaft 5.

The moment the operation shaft 5 is depressed, the resilient bushing 53 at the bottom end of the operation shaft 5 depresses the shaft contact portion 111 connected to circuit 11, which is already connected with the mutual terminal 16 and the connecting terminal C1. Thus, two output pins under the shaft contact portion 111 will be connected with the mutual terminal 16 and the connecting terminal C1 to transmit a predetermined signal.

Regarding the encoding mode of this invention, the BCD (Binary Coded Decimal) and the Gray Coded Decimal system are adopted to encode decimal digits into binary codes as shown in FIGS. 8A and 8B. The POSITION 1~15 (0 for reset) may represent specified files, web-site assortment, multimedia playing, etc, with associated setup software so as to transmit distinct output signals for easy operation.

In short, by taking advantage of the alignment and combination of the contact protrusion pattern 22 together with the contact member array 12, fifteen kinds of predetermined circuitry signal, namely, fifteen function keys with different instructions are obtainable, and moreover, the alignment and combination sets of the contact protrusion pattern 22 may be varied and substituted for function keys in a keyboard for minimizing occupied space and reducing production cost.

Although, this invention has been described in terms of preferred embodiments, it is apparent that numerous variations and modifications may be made without departing from the true spirit and scope thereof, as set forth in the following claims.

What is claimed is:

1. A rotary switch comprising:

a housing defining a chamber and having a second central through hole, said housing forming on a first side a plurality of axially extending cams separated by grooves and spaced circumferentially around the second central through hole, and an axially extending ring coaxial to the second through hole and located near the periphery of said housing;

a rotary dial forming a first central through hole, a cylindrical, binding member extending from a peripheral edge of said first through hole on a first side of said rotary dial, circular support projections peripherally and concentrically extending axially from the first side of the rotary dial and having a central groove so as to engage with said ring of said housing, and an indexing band frame extending from the first side and being tangential to said plurality of cams when said housing and said rotary dial are engaged;

an indexing band comprising a central ridge, said indexing band being held by said indexing band frame and mounted so that said central ridge is operatively engageable with said plurality of cams on said housing for holding said rotary dial and;

an operation shaft including an upper portion that extends upward through the binding member and the first through hole, and a lower portion having two diametrically opposed wing protrusions extending radially from a lower end of said operation shaft, said lower portion of said operation shaft forming a central axially extending recess for receiving a complementary resilient bushing;

a contact plate having a central square shaped through hole and a plurality of contact protrusions axially extending in a predetermined sequence, wherein the lower portion of the operation shaft and said binding member slidably extend through said second through hole and said third through hole, said binding member being held in position with said contact plate so that said rotary dial and said contact plate are rigidly joined;

a planar plate-shaped circuit board forming two grooves for receiving said two wing protrusions of said operation shaft, said circuit board having a contact member array operably engageable against said contact protrusions, a shaft contact portion arranged so as to engage with a lower end of said operation shaft, said shaft contact portion operating when pressed by the lower end of the operation shaft in accordance with axial movement of said operation shaft, wherein said housing connects to said circuit board so as to allow said rotary dial to rotate together with said contact plate, said housing and said circuit board being stationary independent of the axial movement of the rotary dial and the contact plate, said shaft contact portion and said contact member array being connected to a mutual terminal and a plurality of connecting terminals C1, C2, C3, C4, C5;

wherein, as the rotary dial is rotated, the contact plate is rotated so that at least one contact protrusion is brought into electrical contact with a linear contact member of said contact member array, an output circuit being formed with said mutual terminal and said connecting terminals when said operating shaft is depressed, whereby rotation of said rotary dial is guided by the ring of the housing.

2. The rotary switch according to claim 1, wherein said binding member comprises a side lug located at the lower end of said binding member and extends toward the depth of said binding member, said binding member being chamfered around an outer peripheral portion of said lower end, said contact plate having a notch located at an inner peripheral portion of said square-shaped through hole for receiving said side lug.

3. The rotary switch according to claim 1, wherein said contact member array forms a plurality of holes at one end that are received by a plurality of protruding rods arranged on the circuit board, said contact member array comprising a plurality of resilient linear members having a central portion projecting transversely from the circuit board so as to form at least one contact point that communicates with at least one of said contact protrusions, said contact member array having another end that communicates with contact leads corresponding to the connecting terminals C2, C3, C4,C5.

4. The rotary switch according to claim 1, wherein the shaft contact portion is a resilient switch.

5. The rotary switch according to claim 1, wherein said circuit board having a circular ring being positioned near peripheral edges of said circuit board and extending outwardly from one side of said circuit board, said circular ring receiving a circular groove formed around the periphery of said contact plate.

6. The rotary switch according to claim 1, wherein said housing forms an outwardly extending flange that communicates with the first side of said rotary dial.

7. The rotary switch according to claim 1, wherein said operation shaft comprises a notch located at a top end for receiving a press button, said rotary switch further comprising a turntable having pins spaced circumferentially on one side of said turntable, said rotary dial having a plurality of holes spaced circumferentially on another side of said rotary dial for receiving said pins of said turntable, said circuit board having a plurality of fixing terminals adapted to communicate with an electronic device requiring a rotary switch.

* * * * *